United States Patent [19]

Wimberly

[11] 4,208,022

[45] Jun. 17, 1980

[54] TWIN REEL BELTWINDER

[76] Inventor: John T. Wimberly, 609 Hadfield St., Marion, Ill. 62959

[21] Appl. No.: 922,062

[22] Filed: Jul. 5, 1978

[51] Int. Cl.[2] ..... B65H 75/40; B65G 23/02

[52] U.S. Cl. ..... 242/86.52; 198/812; 198/866; 242/55; 242/58.6; 242/67

[58] Field of Search ..... 242/86.52, 86.51, 58.6, 242/67, 86.5 R, 55, 54 R; 198/812, 866

[56] References Cited

U.S. PATENT DOCUMENTS

| | | | |
|---|---|---|---|
| 2,846,051 | 8/1958 | Craggs et al. | 198/812 |
| 2,933,177 | 4/1960 | Long | 198/812 |
| 3,501,109 | 3/1970 | Edson | 242/86.52 |
| 3,685,756 | 8/1972 | Marx et al. | 242/58.6 |
| 4,015,791 | 4/1977 | Price | 242/58.6 |

FOREIGN PATENT DOCUMENTS

| | | | |
|---|---|---|---|
| 1225549 | 9/1966 | Fed. Rep. of Germany | 198/812 |

*Primary Examiner*—George F. Mautz

*Attorney, Agent, or Firm*—Mawhinney, Mawhinney & Connors

[57] ABSTRACT

The present invention is directed to a twin reel beltwinder which is designed to support an indeterminate length of conveyor belt for transportation within a mine cavity. The present invention includes a frame structure rotatably mounted on four wheels and including a framework for supporting a roll of conveyor belt. The entire roll of conveyor belt is initially positioned on one arm of the support structure. Subsequently, a portion of the conveyor belt is unreeled onto the second arm of the support structure. By equally distributing the conveyor belt between the first arm and the second arm of the support structure, the overall height of the apparatus is low enough to be accommodated within a mine cavity.

7 Claims, 8 Drawing Figures

TWIN REEL BELTWINDER

BACKGROUND OF THE INVENTION

1. Field of the Invention

The present invention is directed to a twin reel beltwinder which may readily accommodate a full roll of conveyor belt for transportation within a mine cavity.

2. Description of the Prior Art

In transporting a product from a mine cavity to the surface it is usually required to employ a conveyor belt. It is conventional to employ a plurality of conveyor belts working in combination with each other to transport a product from the mine face to the surface.

Conveyor belts which are utilized to transport a product eventually deteriorate and must be replaced. Previous apparatus employed to replace a conveyor belt which is positioned deep within a mine cavity have proven to be extremely awkward and difficult to manage.

One obstacle in replacing a conveyor belt within a mine cavity is the height restrictions of the mine tunnel. The height limitations of a mine tunnel restrict the transportation of a large roll of replacement conveyor belt to the area where it is needed. To overcome this obstacle, an apparatus is available in the prior art which positions the conveyor belt on its side for transportation through the mine tunnels. After the conveyor belt is delivered to the area where it is needed, it is either unwound with its axis positioned in a vertical direction or it is removed from its support and positioned with its axis in the horizontal position. This type of beltwinder is extremely difficult to manage. Further, if the belt has to be positioned with its axis in the horizontal position, an overhead lifting device must be provided and many man hours are wasted.

SUMMARY OF THE INVENTION

It is an object of the present invention to provide an apparatus for conveniently supporting a full roll of conveyor belt on a first arm thereof. Subsequently, a portion of the conveyor belt is unrolled onto a second arm for transportation within the limited height restricted areas of a mine tunnel.

It is a further object of the present invention to provide an apparatus which may be readily operated by hydraulic fluid to position the support arms and to wind or unwind the conveyor belt.

A still further object of the present invention is to provide an apparatus which may readily transport a full roll of conveyor belt within a mine cavity and which may readily be utilized to effect the removal and replacement of a worn conveyor belt.

It is an object of the present invention to provide an apparatus which may be operated by the hydraulic power provided by a mine tractor or may be readily operated by electricity provided by either the mine tractor or the mine electrical system. A still further object of the present invention is to provide an apparatus which may accommodate various widths of conveyor belts.

These and other objects of the present invention are accomplished by providing a framework which is mounted on four wheels for transporation within a mine cavity. Positioned on the framework is a support structure which includes a first pivotally mounted arm which rotatably positions a spindle on which the conveyor belt is positioned. The support structure includes a second pivotally mounted arm which includes a second spindle on which a portion of the conveyor belt is unreeled. After the conveyor belt is equally distributed between the first and second arms, the overall height of the apparatus is sufficient to permit it to be transported within the limited height restriction areas of a mine tunnel. After the apparatus is transported to an area where it is desired to replace a conveyor belt, the new belt is completely unreeled onto the second arm of the support structure. The old belt is severed and one end thereof is spliced to the free end of the new conveyor belt. The other end of the old conveyor belt is attached to the spindle of the first arm of the support structure. Thereafter, as the old belt is wound on the spindle positioned on the first arm of the support structure, the new belt is unwound to replace the old belt.

Other objects of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
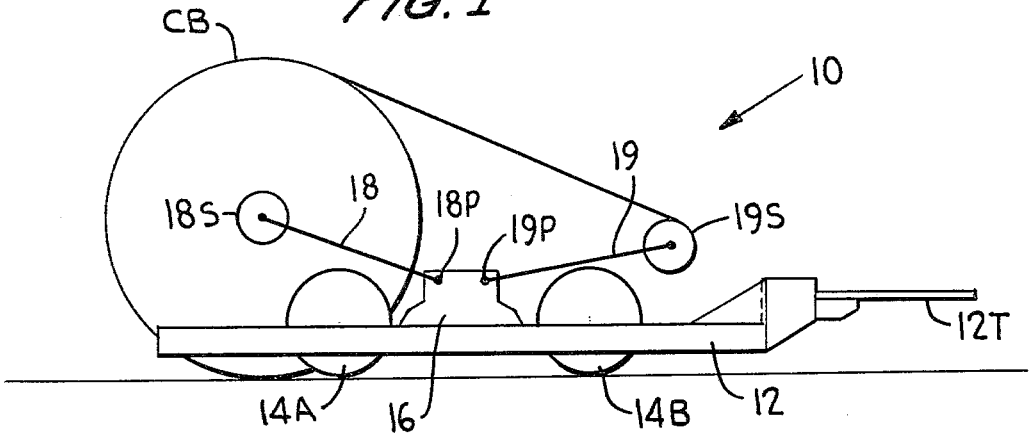
FIG. 1 illustrates a side view of the apparatus of the present invention wherein the entire roll of the conveyor belt is positioned on the first arm of the support structure.
Figure 2:
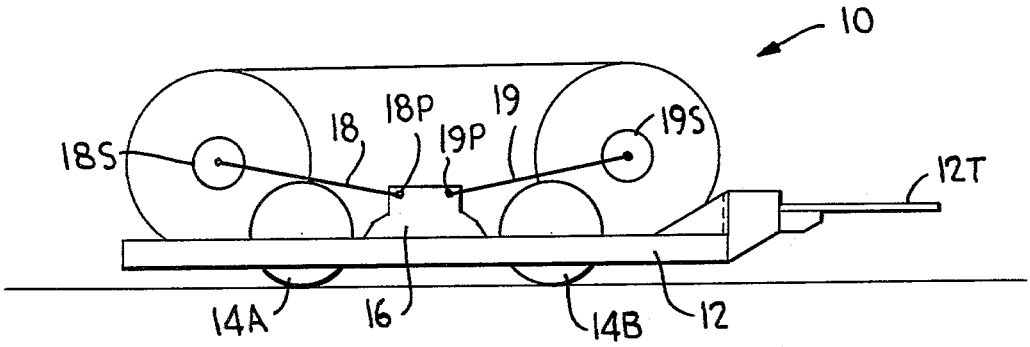
FIG. 2 illustrates a side view of the apparatus of the present invention wherein the conveyor belt is equally distributed between the first and second arms of the support structure.
Figure 3:
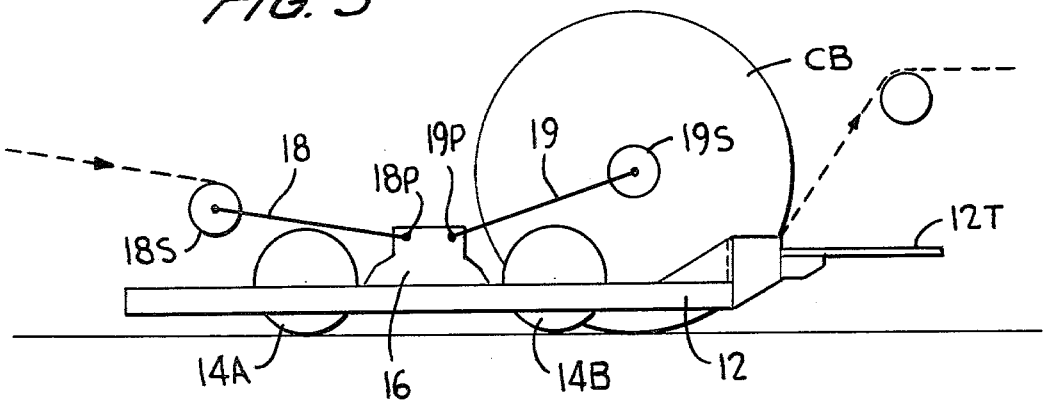
FIG. 3 illustrates a side view of the apparatus of the present invention wherein the new roll of the conveyor belt is positioned on the second arm of the support structure and the old belt is illustrated as being wound upon the first arm of the support structure.

Referring to FIGS. 1–3, there is illustrated a twin reel beltwinder and transporter 10 which includes a framework 12, for support wheels 14A, 14B (14C, 14D not shown) and a support structure 16 mounted on the framework. The support structure 16 includes a first arm 18 and a second arm 19 pivotally mounted at 18P and 19P, respectively, to the support structure.

The first arm 18 includes a spindle 18S mounted at the outermost portion of the first arm. Likewise, the second arm 19 includes a spindle 19S mounted at the outermost portion of the second arm.

Figure 4:
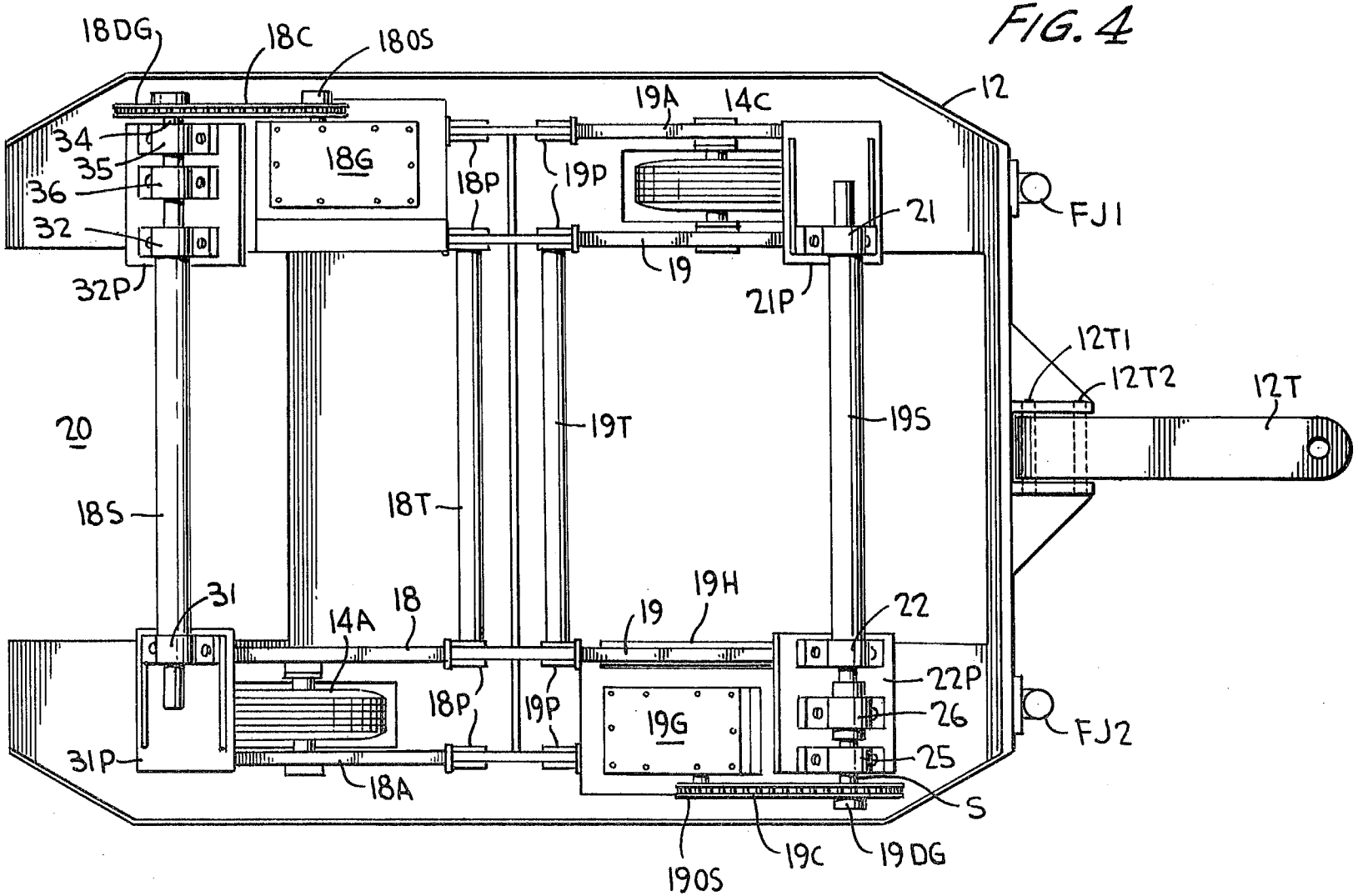
FIG. 4 illustrates a plan view of the twin reel transporter of the present invention.

As illustrated in FIGS. 1 and 4, because the framework 12 has an open rear portion, a full roll of conveyor belt may be conveniently positioned adjacent the rear end of the frame work 12 so that the spindle shaft 18S may be inserted within the belt core. Upon inserting the spindle 18S within the belt core, the conveyor belt CB may be raised onto the framework 12. As illustrated in FIG. 1, initially the full conveyor belt CB is positioned entirely on the spindle 18S. After the conveyor belt CB is raised onto the framework the leading end of the conveyor belt is attached to the spindle 19S and a portion thereof is transferred to this spindle.

As illustrated in FIG. 2, after approximately one-half of the conveyor belt CB is transferred from the spindle 18S to the spindle 19S, the overall height of the apparatus has been reduced to thereby permit the apparatus to be transported within the limited height restriction areas of a mine tunnel. The tongue 12T of the framework 12 may readily be attached to a tractor which can easily transport the framework within a mine tunnel.

As illustrated in FIG. 3, after the framework 12 is positioned adjacent the portion of a conveyor belt which is to be replaced, the entire new conveyor belt CB is removed from the spindle 18S and positioned on the spindle 19S. Thereafter, the old conveyor belt is severed with one end thereof being attached to the spindle 18S and the other end thereof being spliced to the new conveyor belt CB. The old conveyor belt may very easily be replaced by merely winding the old belt on the spindle 18S as the new belt is supplied from the spindle 19S.

The apparatus of the present invention is very economical in that the apparatus supplies only the quantity of new conveyor CB which is needed to replace the old conveyor belt. After the new conveyor belt is supplied to the segment of the conveyor which must be replaced, the quantity of belt on the spindle 18S and 19S is adjusted so as to be approximately equal. In this manner, the framework 12 is again ready for transportation within the limited height restriction areas of a mine tunnel.

Figure 5:
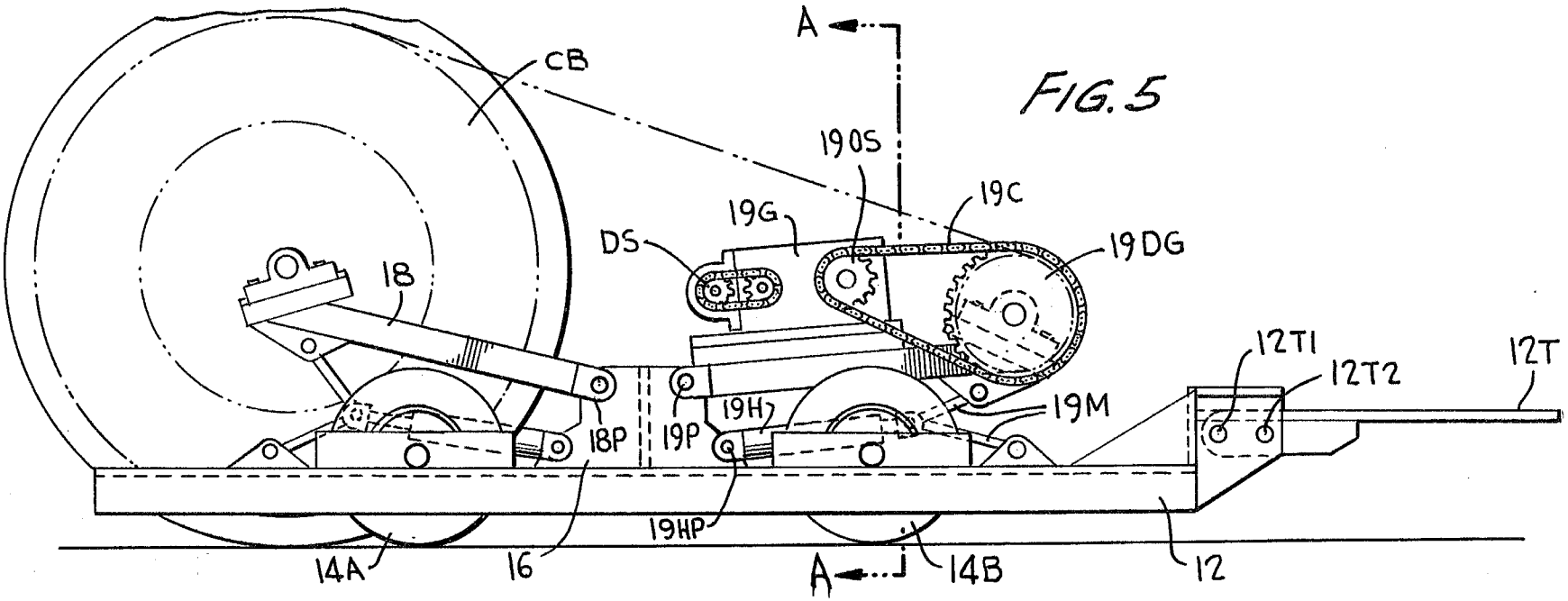
FIG. 5 illustrates a side view of the winding and unwinding mechanism of the second arm of the support structure.
Figure 6:
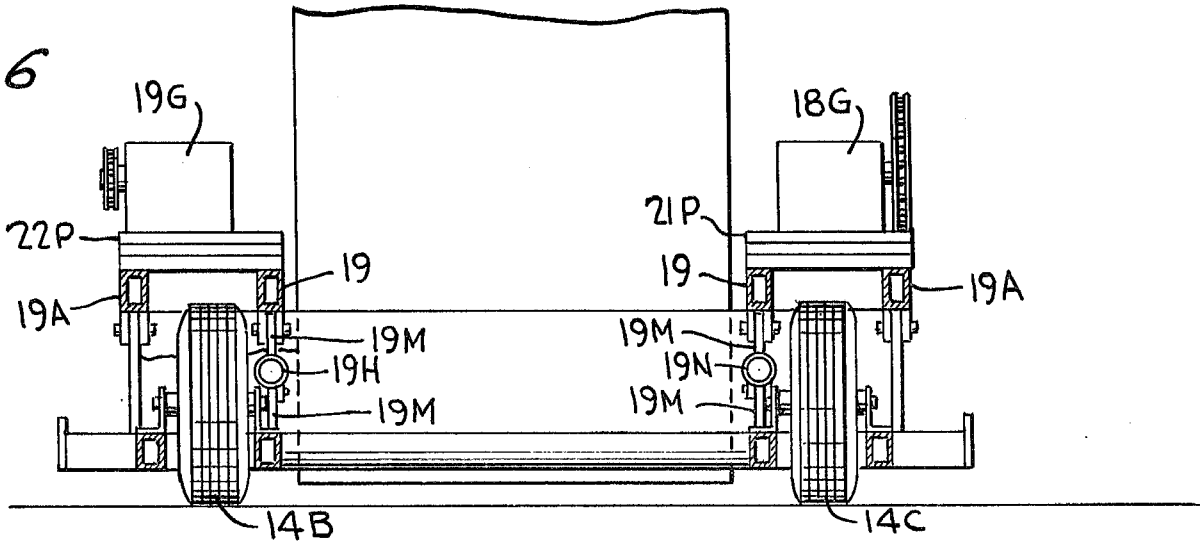
FIG. 6 illustrates a cross-sectional view taken along line A—A of FIG. 5.

FIGS. 4–6 illustrate a preferred embodiment of the present invention. The twin reel belt winder 10 includes the framework 12 which is mounted on the four wheels 14A–14D. The framework 12 includes a tongue 12T which is attached thereto by means of two removeable pins 12T1 and 12T2. The tongue T may either be removed from the framework 12 or by merely removing one of the pins 12T1 or 12T2, an individual may pivotally mount the tongue 12T on the framework 12.

At the rear most end of the framework 12 is an open portion 20 into which a full reel of conveyor belts may be positioned. As previously discussed, to load the apparatus an individual would merely back the framework 12 up to a full roll of belt so that the belt was positioned within the opened area 20. Thereafter, the spindle 18S would be positioned within the belt core. Thereafter, the arm 18 would be raised so as to support the conveyor belt CB on the framework 12.

The arm 18 is raised by means of two hydraulic jacks which are pivoted at one end thereof to the support structure 16. The other end thereof is pivoted to two members one of which is pivotally mounted to the framework 12 and the other member is pivotally mounted to the arm 18. In this manner, as the hydraulic jack is actuated the two members expand relative to each other so as to raise the arm 18. The arm 18 is positioned on each end of the spindle 18S. A torque tube 18T connects the two arms 18 together.

As previously discussed, after the conveyor CB is positioned on the spindle 18S and the two arms 18 are raised by means of the hydraulic jacks, the free end of the conveyor belt CB is attached to the spindle 19S. Thereafter, power is supplied to the drive shaft DS which is in operative connection with the gear reducing unit 19G which transmits the power through the output shaft 19OS through the chain drive 19C to the drive gear 19DG. In this manner the conveyor belt CB is unreeled from the spindle 18S onto the spindle 19S. After a predetermined quantity of conveyor belts is transferred from the spindle 18S to the spindle 19S the operator would disconnect the power to the drive shaft DS and thereby terminate the transfer of the belt to the spindle 19S.

As illustrated in FIG. 4, each end of the spindle 19S is mounted in a bearing 21, 22 which is positioned on a plate 21P, 22P, respectively.

Referring to FIGS. 4 and 6, the plates 21P, 22P are mounted on the arms 19, 19A for upward and downward movement. The arm 19 is raised by means of the hydraulic jack 19H which includes two members 19M which are pivotally mounted on the outer end of the hydraulic jack 19H. Upon acutation of the hydraulic jack 19H, the two arms 19M move upwardly in a scissors-like fashion to raise the arm 19 and thereby raise the platforms 21P, 22P.

The gear reducer 19G is mounted on the platform 22P. Similarly the drive gear 19DG is mounted to a shaft S which is positioned within a bearing 25 and its outer end thereof together with the outer end of the spindle 19S are mounted in a bearing 26. Rotary motion imparted to the drive gear 19DG is imparted to the shaft S which in turn transmits the motion to the outer end of the spindle 19S through the bearing 26.

As illustrated in FIGS. 4 and 6, the bearings 22, 25, 26 are all positioned on the platform 22P.

Similarly, the gear reducer 18G is connected to the output of a drive shaft and includes an output shaft 18OS which is connected by a chain 18C through which power is supplied to the drive gear 18DG. The gear reducer 18G together with the bearings 32, 35 and 36 are mounted on a support plate 32P. Power supplied to the drive gear 18DG is transmitted through a shaft 34 which is mounted in a bearing 35 and its outer end is positioned within a bearing 36. The spindle 18S is mounted in a bearing 32 and its outer end is positioned together with the outer end of the shaft 34 within the bearing 36. In this manner, power transmitted to the drive gear 18DG is transmitted through the shaft 34 to the spindle 18S. The other end of the spindle 18S is mounted in a bearing 31 which is positioned on a support plate 31P.

The support plates 31P, 32P are mounted on the two arms 18, 18A which are pivotally mounted at 18P to the support structure 16. Again, a torque tube 18T connects the two arms 18 together.

As illustrated in FIG. 5, the arm 19 is pivotally mounted at 19P to an upper portion of the support structure 16. The hydraulic jack 19H is pivotally mounted at 19HP to a lower portion of the support structure 16. In this manner, the necessary leverage is produced as the hydraulic jack 19H is actuated so as to permit the raising of the arm 19 as the two members 19M scissors outwardly in their upward motion.

Referring to FIG. 4, at the portion of the framework 12 adjacent the tongue 12T there are illustrated two floor jacks FJ1, FJ2. Although this embodiment of the invention utilizes only two floor jacks it should be understood that four floor jacks may be positioned one at each of the corners of the framework 12. Further, in a third embodiment of the present invention a floor jack may be mounted on the portion adjacent the tongue 12T.

Although reference has been made to the drive shaft DS, it is to be understood that any means of supplying power to the gear reducers may be utilized in combination with the present invention. In other words, power may be supplied to the gear reducers by hydraulic fluid, an electric motor, a gas motor, or any other means by which rotary motion may be imparted to a drive shaft to thus impart motion to the gear reducers. Further, if an electric motor is utilized, it may be operated by the electric power generated by the tractor or it may be operated by electric power within the mine tunnel. The present invention contemplates all types of power which may be transmitted to a drive shaft to thereby turn the gears within the gear reducers.

Figure 7:
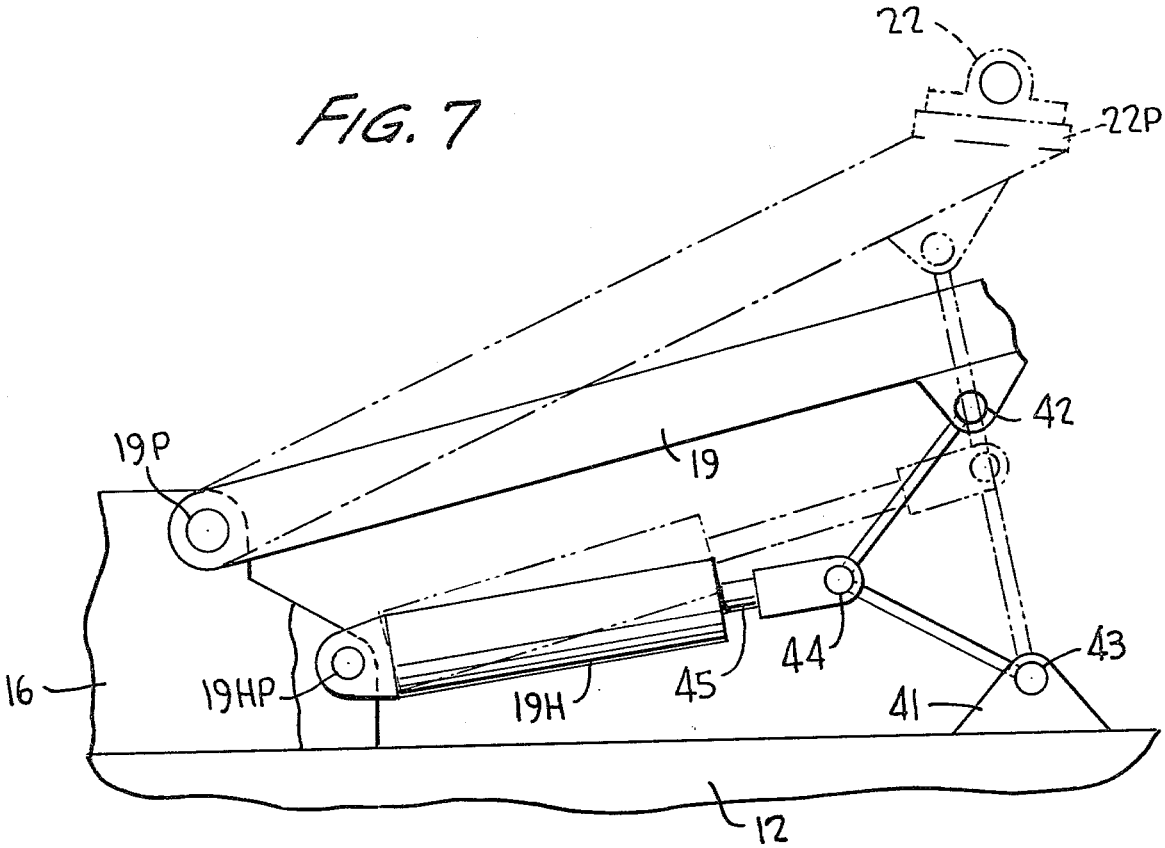
FIG. 7 illustrates an apparatus for pivoting a arm of the support structure upwardly.

Referring in detail to FIG. 7, there is illustrated in solid lines the hydraulic jack 19H before being actuated to the raised position. The hydraulic jack 19H is pivotally mounted at 19HP to a lower portion of the support structure 16. The jack includes an actuating rod 45 which is pivotally mounted at 44 to the two arms 19M. One arm 19M is pivotally mounted at 43 to a support member 41 which is attached to the framework 12. The other arm 19M is pivotally mounted at 42 to the arm 19. As illustrated in phantom lines in FIG. 7, as the hydraulic jack 19H is actuated, the rod 45 is projected outwardly thereby moving the arms 19M in a scissors-like fashion until they are fully extended. In the fully extended position, the arm 19 is raised to thereby raise the spindle 19S on which the conveyor belt CB is positioned.

Figure 8:
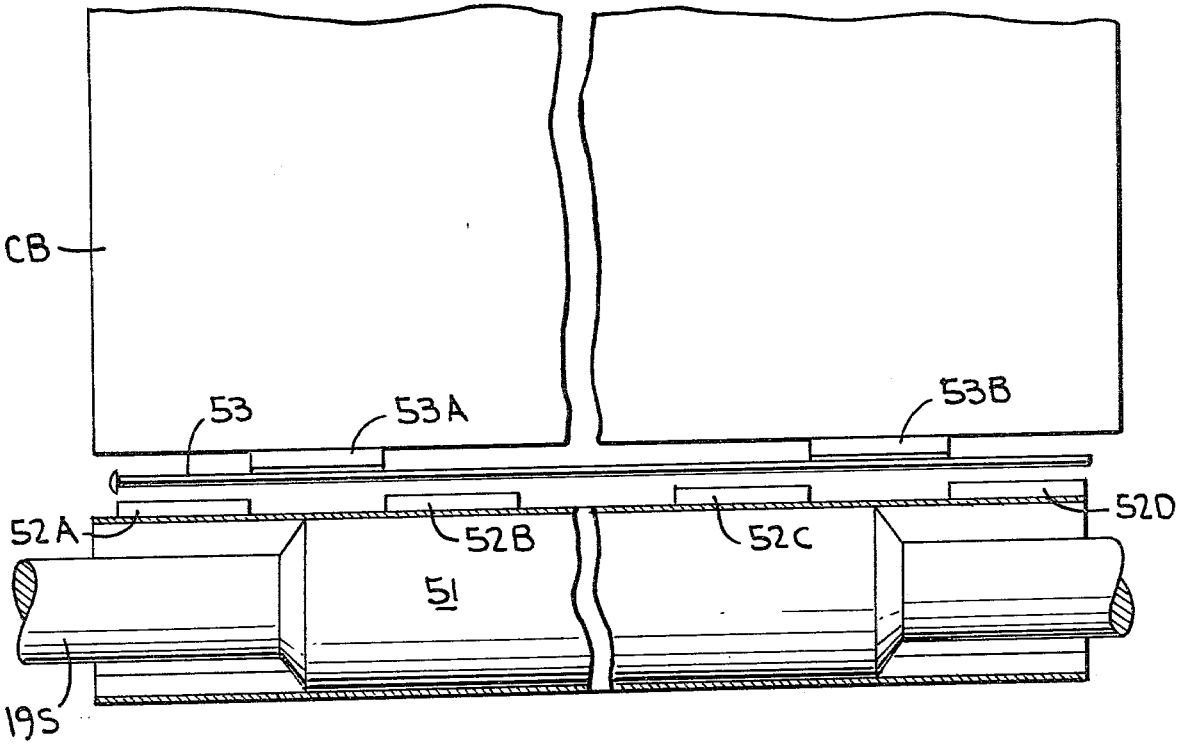
FIG. 8 illustrates a cross-sectional view of a roll of conveyor belt.

Referring to FIG. 8, there is illustrated the spindle 19S which includes an enlarged central portion 51. The enlarged central portion 51 is designed to snugly mate with a sleeve 52 on which a plurality of projections 52A–52D are positioned. The conveyor belt CB is wound on a core 53 which includes a plurality of projections 53A, 53B. As illustrated in FIG. 8, the projections 52A through 52D are spaced on the sleeve 52 so as to accomodate the projections 53A, 53B on the core 53.

OPERATION OF THE PREFERRED EMBODIMENT

In operation, an individual would connect the tongue 12T of the framework 12 to a tractor and thereafter back the open portion 20 of the framework 12 adjacent to a full roll of conveyor belt CB. This may be accomplished either on the surface adjacent a mine tunnel or within the mine. After the full roll of conveyor belt is positioned on the spindle 18S which is mounted on the arms 18, 18A, the arms 18, 18A are raised upwardly thereby positioning the conveyor belt CB on the framework 12. Thereafter, the free end of the conveyor belt is attached to the spindle 19S. Upon supplying power to the gear reducer 19G motion is imparted to the drive gear 19DG which imparts motion to the shaft S which thereafter imparts motion through the bearing 26 to the outer end of the spindle 19S. An individual operating the apparatus will unroll a quantity of conveyor belt onto the spindle 19S until the portion of the belt on the spindle 18S is approximately equal to the portion of the belt on the spindle 19S.

After properly distributing the conveyor belt between the two spindles, the overall height of the apparatus is sufficient to permit it to be transported within the limited height restriction areas of a mine tunnel. The operator would transport the conveyor belt within the mine tunnel to the portion of the old conveyor belt which is to be replaced.

Upon transporting the new conveyor belt to the site where it is to be utilized, the floor jacks FJ1, FJ2 are actuated to thereby firmly position the apparatus within the mine tunnel. Thereafter, the conveyor belt CB is transported from the spindle 18S onto the spindle 19S. The old conveyor belt is severed and one end thereof and attached to the spindle 18S. The other end of the old conveyor belt is spliced to the free end of the new conveyor belt which is positioned on the spindle 19S. Thereafter, the old conveyor belt is rolled onto the spindle 18S by imparting motion to the spindle 18S through the drive gear 18DG which is connected to the chain 18C which is supplied with power from the output shaft 18OS. The gear reducer 18G is supplied with power by means of a drive shaft DS (not shown) through any suitable source of power. As previously discussed, a suitable source of power for the apparatus of the present invention may be hydraulic, electric or any other means of imparting rotary motion to the gears within the gear reducer 18G. The operator of the apparatus would monitor the supply of old conveyor belt which was being rolled onto the spindle 18S and would monitor the new conveyor belt CB which is being supplied from the spindle 19S. After the portion of the old conveyor belt is replaced, the operator would sever the new conveyor belt from the spindle 19S and would splice together the two ends of the conveyor belt. The old conveyor belt which is positioned on the spindle 18S would be equally distributed between the spindles 18S and 19S. In this manner, the apparatus is now ready to be transported through the limited height restriction areas of a mine tunnel and be returned to the surface.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A twin reel beltwinder apparatus for use in supporting an indeterminate length of conveyor belt for transportation within a mine cavity comprising:

a framework mounted on support wheels, said framework including a front end and a rear end;

a first set of arms pivotally mounted at one end to a central portion of said framework and extending rearwardly therefrom, said first set of arms including means at the other end thereof for securing a full reel of conveyor belt;

a second set of arms pivotally mounted at one end to said central portion of said framework and extending forwardly therefrom, said second set of arms including spindle means at the other end thereof unto which a portion of the conveyor belt is positioned to reduce the overall height of said full reel of conveyor belt initially positioned on said first set of arms;

a first jack means operatively connected to said first set of arms for actuating said first set of arms between a raised and a lowered position;

a second jack means operatively connected to said second set of arms for actuating said second set of arms between a raised and a lowered position;

means for imparting a rotary motion being operatively connected to said spindle means on said second set of arms to wind a portion of said conveyor belt from said full reel of conveyor belt unto said spindle means;

means for imparting a rotary motion being operatively connected to said means for securing a full reel on said first set of arms for winding or unwinding said conveyor belt therefrom;

said support wheels of said framework and said first and second sets of arms being operatively disposed relative to each other to provide an unobstructed path between said means for securing said full reel of conveyor belt and said spindle means to permit uninhibited winding and unwinding of said conveyor belt therebetween.

2. A twin reel belt winder apparatus according to claim 1, wherein said jack means for actuating said first set of arms between a raised and a lowered position comprises a hydraulic jack.

3. A twin reel belt winder apparatus according to claim 1, wherein said means for securing a full reel of conveyor belt on said first set of arms includes a spindle on which a reel of conveyor belt is positioned.

4. A twin reel belt winder apparatus according to claim 3, wherein said means for imparting rotary motion is operatively connected to said spindle and includes a drive shaft, a gear reducer which includes an output shaft and a drive gear connected to said spindle.

5. A twin reel belt winder apparatus according to claim 1, wherein said jack means for actuating said second set of arms between a raised and a lowered position comprises a hydraulic jack.

6. A twin reel belt winder apparatus according to claim 1, wherein said means for imparting rotary motion to said spindle means includes a drive shaft, a gear reducer which includes an output shaft and a drive gear connected to said spindle means.

7. A method of transporting and handling an indeterminate length of replacement conveyor belt within a mine cavity comprising the following steps:

securing a full reel of replacement conveyor belt onto an outer end of a first set of arms pivotally mounted at the other end to a framework, said framework being mounted on support wheels;

distributing a portion of said replacement conveyor belt from said outer end of said first set of arms to an outer end of a second set of arms pivotally mounted at the other end to said framework, said distributing effecting a reduction in the overall height of said full reel of said replacement conveyor belt;

transporting said full reel of replacement conveyor belt having a reduced overall height within limited height restricted areas of a mine tunnel;

winding the remaining portion of said replacement conveyor belt from said outer end of said first set of arms onto said outer end of said second set of arms; and winding a used conveyor belt unto said outer end of said first set of arms while unwinding said replacement conveyor belt from said outer end of said second set of arms to replace said used conveyor belt without wasting any portion of said replacement conveyor belt.

* * * * *